US006357270B1

(12) United States Patent
Vazquez

(10) Patent No.: US 6,357,270 B1
(45) Date of Patent: Mar. 19, 2002

(54) FREE-WHEELING DOOR LOCK MECHANISM

(75) Inventor: Cesar Vazquez, Mexico City (MX)

(73) Assignee: Scovill Locks, S.A. de C.V., Col. Granjas Mexico (MX)

( * ) Notice: Subject to any disclaimer, the term of this patent is extended or adjusted under 35 U.S.C. 154(b) by 0 days.

(21) Appl. No.: 09/396,671

(22) Filed: Sep. 8, 1999

(51) Int. Cl.[7] ..... E05B 13/10

(52) U.S. Cl. ..... 70/472; 70/149; 70/224; 292/336.3

(58) Field of Search ..... 70/149, 223, 224, 70/218, 222, 472, 489; 292/352, 359, 347, 348, 336.3

(56) References Cited

U.S. PATENT DOCUMENTS

| | | | | | |
|---|---|---|---|---|---|
| 4,920,773 | A | | 5/1990 | Surko, Jr. | 70/224 |
| 5,004,278 | A | * | 4/1991 | Kang et al. | 292/336.3 X |
| 5,018,375 | A | * | 5/1991 | Tully | 70/472 |
| B14,920,773 | | | 1/1997 | Surko, Jr. | 70/224 |
| 5,727,406 | A | | 3/1998 | Banducci | 70/224 |
| 5,732,578 | A | * | 3/1998 | Kang | 70/224 |
| 5,768,926 | A | * | 6/1998 | Shen | 70/472 |
| 5,794,472 | A | * | 8/1998 | Kester et al. | 70/472 |
| 5,816,086 | A | * | 10/1998 | Russell, IV | 70/223 X |
| 5,868,018 | A | * | 2/1999 | Kang | 70/472 |
| 5,904,232 | A | * | 5/1999 | Shen | 70/224 X |
| 5,992,189 | A | * | 11/1999 | McCaa | 70/149 |
| 6,014,878 | A | * | 1/2000 | Shen | 70/472 |
| 6,038,896 | A | * | 3/2000 | Chamberlain et al. | 70/279.1 |
| 6,085,561 | A | * | 7/2000 | Yao | 70/472 |
| 6,101,856 | A | * | 8/2000 | Pelletier et al. | 70/472 |
| 6,151,934 | A | * | 11/2000 | Chong et al. | 70/224 X |
| 6,189,351 | B1 | * | 2/2001 | Eagan et al. | 70/472 |
| 6,216,500 | B1 | * | 4/2001 | Kang | 70/224 |
| 6,223,567 | B1 | * | 5/2001 | Fadul | 70/149 |

* cited by examiner

*Primary Examiner*—Suzanne Dino Barrett
(74) *Attorney, Agent, or Firm*—DeLio & Peterson, LLC

(57) ABSTRACT

A free-wheeling lock mechanism for a cylindrical door lock includes inner and outer spindles directly and non-rotatably connected to corresponding inner and outer lever handles. A latch retractor is located between the spindles and a cylindrical outer cam is located within the outer spindle. The outer cam can slide axially in the outer spindle and includes an approximately T-shaped cam slot having longitudinal and circumferential portions forming the T-shape. A cam scoop is located on the perimeter of the outer cam which extends into the latch retractor and operates the latch retractor to open the door when the outer cam is rotated. The outer spindle has an inwardly projecting finger that cooperates with the cam slot to unlock and lock the mechanism as the outer cam slides axially to align the finger with the longitudinal or circumferential portions of the cam slot. In the unlocked position the finger projects into the longitudinal portion of the cam slot so that rotation of the lever handle turns the outer cam and opens the door. In the locked position the finger projects into the circumferential portion of the cam slot so that the finger does not engage the outer cam and rotation of the lever handle does not open the door.

20 Claims, 6 Drawing Sheets

FREE-WHEELING DOOR LOCK MECHANISM

BACKGROUND OF THE INVENTION

1. Field of the Invention

The present invention relates to the locking mechanism in door locks of the type which allow the handle to "free-wheel", i.e., rotate without retracting the latch bolt, when the mechanism is locked.

2. Description of Related Art

Doors are much easier to open when the door handle is shaped as a lever handle rather than a conventional door knob. For this reason, lever handles are preferred in some applications, and they may be required under applicable regulations for certain doors in public buildings to facilitate access by the disabled and the elderly.

However, the lever shape of the door handle allows much greater force to be applied to the internal locking mechanism of the door than can be applied with a round door knob. In most door locks, the locking mechanism prevents the door knob from turning when the door is locked. When a round door knob is replaced by a lever handle, the greater leverage available from such a handle may allow a vandal or thief to break the internal components of the door lock by standing or jumping on the lever end of the handle. This problem is particularly acute for cylindrical locks which have less internal room than mortise type locks to accommodate heavy duty locking components.

To address this problem, the present invention has been designed such that the outer lever handle is disengaged from the locking mechanism and allowed to free-wheel when the door lock mechanism is locked. This allows the lever handle to rotate freely without operating the locking mechanism and prevents the lever handle from being used to overstress the internal components of the lock.

Free-wheeling door locks which have previously been developed have been expensive due to the large number of parts, the multiple manufacturing steps needed to make the parts and the difficulty of assembly of the lock at the factory. U.S. Pat. No. 4,920,773 is indicative of such a free-wheeling lock wherein numerous components are necessary to disengage the lever handle from the lock. In particular, such components are necessary when the spindle is to be disconnected from the lever handle.

In prior art designs, the spindle has heretofore always been directly and non-rotatably connected to the handle operating it. The present invention addresses these problems through a design which includes relatively fewer parts and simpler parts that can be manufactured with fewer steps and which are quickly and easily assembled in the factory and in the field. The present invention also addresses this problem by designing the spindle so that it may continue to be directly and non-rotatably connected to the spindle as in the prior art designs, while still providing free-wheeling operation when locked.

Bearing in mind the problems and deficiencies of the prior art, it is therefore an object of the present invention to provide a free-wheeling lever handle lock mechanism that is relatively less expensive to construct and assemble than prior art free-wheeling lock mechanisms.

It is another object of the present invention to provide a free-wheeling lever handle lock mechanism that has fewer components than prior art free-wheeling lock mechanisms, and where the components are easy to manufacture and assemble.

A further object of the present invention is to provide a free-wheeling lever handle lock mechanism wherein the lever handle always turns the spindle to which it is attached.

Still other objects and advantages of the invention will in part be obvious and will in part be apparent from the specification.

SUMMARY OF THE INVENTION

The above and other objects, which will be apparent to those skilled in art, are achieved in the present invention which is directed to a free-wheeling lock mechanism which includes a latch retractor, a spindle having an inwardly projecting finger, and a cam rotatably held within the spindle. The cam includes a cam scoop that retracts the latch retractor when the cam is rotated and a cam slot which interacts with the finger on the spindle to lock and unlock the mechanism.

The cam slot has a longitudinal portion and a circumferential portion and the cam is axially slidable relative to the spindle from an unlocked position to a locked position. In the unlocked position the finger projects inwardly from the spindle into the longitudinal portion of the cam slot to couple the spindle to the cam. In this position rotation of the spindle rotates the cam to open the door. In the locked position the finger projects inwardly from the spindle into the circumferential portion of the cam slot. In this position the spindle will free-wheel relative to the cam and rotation of the spindle will not open the door. This design allows the lever handle to be directly and non-rotatably connected to the spindle in the usual manner of lock mechanism that do not free-wheel, while still providing free-wheeling performance. This arrangement provides for a lower cost device.

In the described embodiment of the invention the cam is biased by a cam spring to slide axially relative to the spindle and position the finger in the longitudinal portion of the cam slot. A lock cylinder assembly is provided which may be turned by a key to turn a tail extending from the lock cylinder. The cam includes an opening for receiving the lock cylinder tail and rotation of the lock cylinder will rotate the cam with the lock cylinder tail to retract the retractor and open the door when the mechanism is locked.

In the preferred embodiment, the cam includes a key guide which is non-rotatably held in an end of the cam opposite the cam scoop and which includes an opening for receiving the lock cylinder tail. The key guide is held in the cam by a lock piece and the lock piece engages the key guide, extending through the key guide and through the cam perpendicular to the central axis of the cam. A cam spring is located between the spindle and the key guide to urge the cam towards the unlocked position.

The lock mechanism also includes a second spindle adapted for non-rotatable connection to a second handle to be mounted on the inner side of the door. The second spindle is located on an opposite side of the latch retractor from the first spindle and has a button lock mechanism mounted within it. The button lock mechanism includes an actuator that extends through the lock and contacts the cam. The actuator is axially movable to move the cam between the locked and unlocked positions.

In the most highly preferred embodiment of the free-wheeling lock mechanism the button lock mechanism is rotatable between first and second positions. In the first position the button lock mechanism allows the cam to return to the unlocked position whenever the latch retractor is retracted. In the second position the button lock mechanism continuously holds the cam in the locked position even after the latch retractor is retracted. Thus, in the first position opening the locked door with the key or the inner handle will unlock the door, while in the second position, opening the door by either method will not leave it unlocked.

The outer lever handle is preferably directly attached in a non-rotatable manner to the spindle via a hollow shaft portion which receives and engages the spindle and the lever portion of the handle is supported in a horizontal orientation by a spring mounted in the rose surrounding the hollow shaft portion of the lever handle.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–6 of the drawings in which like numerals refer to like features of the invention.

Figure 1:
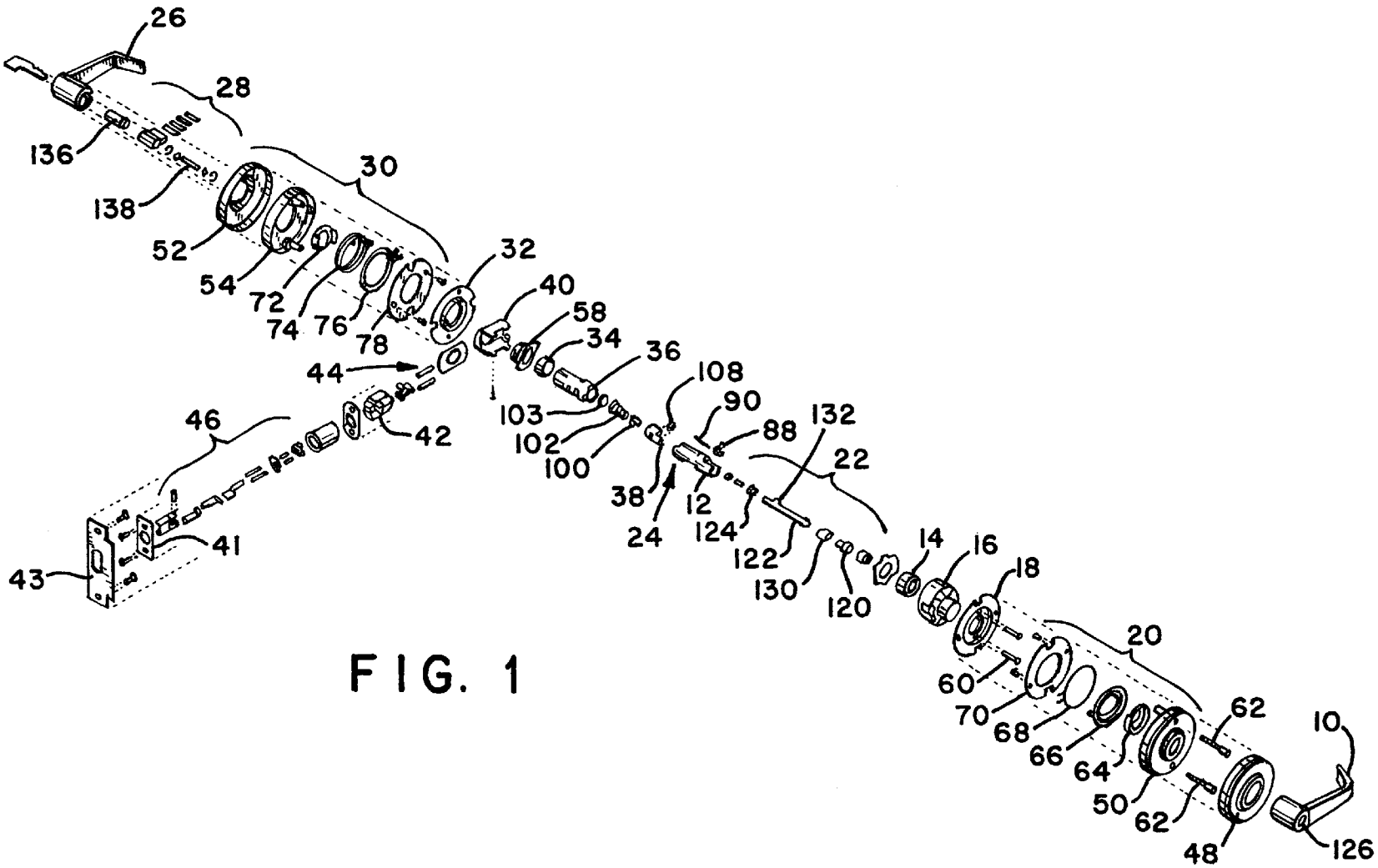
FIG. 1 is an exploded perspective view of the free-wheeling lock mechanism of the present invention with associated lever handles, latch bolt and door hardware.
Figure 2:
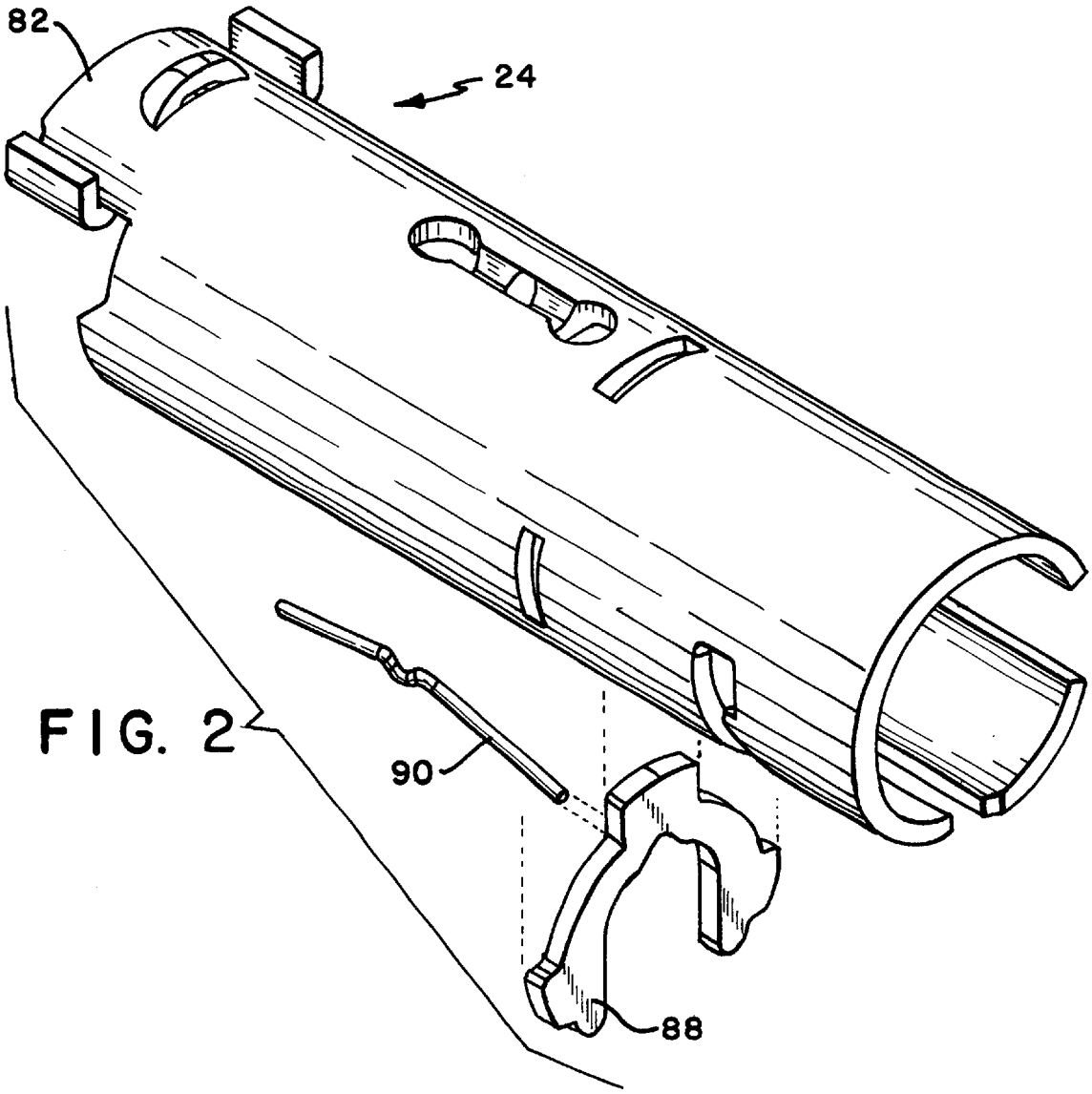
FIG. 2 is a perspective view of the inner portions of the free-wheeling lock mechanism of the present invention showing the inner spindle.

FIG. 1 provides an exploded view of a free-wheeling lock incorporating a free-wheeling lock mechanism according to the present invention. The free-wheeling lock mechanism described generally includes an inner side and an outer side. The inner side includes those components that are on the inside of the door being locked, i.e., in the secure area, and the outer side includes those components that are on the outer side of the door, i.e., in the public area. Referring to FIGS. 1 and 2, the inner side of the free-wheeling lock includes an inner lever handle 10 connected to an inner spindle 12. The connection between the inner lever handle 10 and the inner spindle 12 is direct and rigid such that there is no relative motion between these two components, and any rotation of the inner handle rotates the inner spindle.

The spindle 12 extends through a bearing 14 mounted in outer housing 16, though inner mounting plate 18 and through inner rose assembly 20 before entering and engaging the inner lever handle 10. The principal inner components of the lock mechanism also include button lock mechanism 22 and inner cam end 24 of the inner spindle 12.

The principal components on the outer side of the lock mechanism include outer lever handle 26, lock cylinder assembly 28, outer rose assembly 30, outer mounting plate 32, outer bearing 34, outer spindle 36 and outer cam 38.

The lock mechanism is mounted to a door with the inner and outer mounting plates 18, 32 which are positioned on opposite sides of the door and hold the lock mechanism within a cylindrical bored opening in the door with the inner spindle extending into the inner side and the outer spindle extending into the outer side of the door. The spindles project outwards from outer latch housing 14 which surrounds inner latch housing 40. Mounted within the inner latch housing 40 is the latch retractor 42 which is spring-biased towards the forward (latched) position by springs 44.

A substantially conventional latch bolt mechanism 46 is retracted by the latch retractor whenever the door is to be opened. The latch bolt extends in the usual manner through an opening in door plate 41 which is flush-mounted in the edge of the door. When the door is closed and locked, the latch bolt extends through door plate 41 and into a corresponding opening in catch plate 43 mounted in the door frame to prevent the door from opening.

Briefly stated, the lock mechanism of this invention acts to lock the door by disengaging the outer lever handle 26 from the retractor 42 in a manner which allows the outer handle to free-wheel or rotate over a limited angular distance without operating the retractor 42 to retract the latch bolt and open the door. This disengagement is principally achieved through the interaction of the outer spindle 36, outer cam 38 and the button lock mechanism 22. Before the details of this interaction are described, however, the basic elements of the lock and surrounding components will be more fully described.

The inner and outer roses provide covers for the interior lock components in the bored opening of the door, however, they are also critical in preventing the lock from being rotated relative to the door and for supporting the weight of the lever handle to keep it horizontal once it has been disconnected from the retractor 42 in the free-wheeling and locked mode.

The inner rose 20 includes a decorative inner scalp 48 which covers an inner rose body 50. The outer rose 30 also includes a decorative outer scalp 52 and an outer rose body 54. The lock components between the inner rose 20 and outer rose 30 form a cylindrical lock body assembly which is assembled at the factory and provided to the installer fully assembled. The lock body assembly is mounted in the bored opening of the door and the inner and outer roses with their corresponding decorative scalps cover opposite sides of the bored opening in the door to hide the latch housing 16. The inner and outer spindles 12, 36 project outward from the door through the inner and outer roses and into non-rotatable engagement with the corresponding lever handles 10, 26.

The inner mounting plate 18 is positioned over inner bearing body 56 and the outer mounting plate is threaded onto the outer bearing body 58. The two mounting plates are held in position by screws 60. The inner and outer roses 20, 30 cover the mounting plates and are held by screws 62 which extend through mounting holes in the door to prevent the lock mechanism from rotating relative to the door.

As may be seen in FIG. 1, the inner and outer roses are substantially identical. The inner rose 20 includes first inner driver 64, second inner driver 66, spring 68 and cover 70. The lever handle turns the first inner driver 64 which turns the second inner driver 66 which contacts spring 68. The spring 68 and the first and second inner drivers 64, 66 act to hold the lever handle in the horizontal position substantially in the manner described in U.S. Pat. No. 5,727,406. Rotation of the handle in either direction away from the level and horizontal position compresses spring 68 which tends to always return the handle to this position. Corresponding elements in the outer rose 30 include first outer driver 72, second outer driver 74, spring 76 and cover 78 which hold the outer lever handle in the horizontal position. The covers 70, 78 attach to their corresponding rose bodies and hold in the corresponding drivers and spring so that each rose may be assembled as a unit at the factory and installed as a single element in the field.

As discussed above, the door can only open when the latch bolt 46 is retracted by the latch retractor 42. This happens only when the inner cam end 24 of the inner spindle 12 or the outer cam 38 in the outer spindle 36 rotate. Both the inner cam end 24 and the outer cam 39 include a "scoop" or curved portion of a cylinder formed as an integral part of the cam and located at an edge thereof. When the lock is installed, the scoop on each cam lies generally at the forward edge of the cam, i.e., on the edge of the cam nearest the free edge of the door (the edge having door plate 41 mounted on it). Further, each scoop projects into engagement with the latch retractor.

Thus, when either cam portion rotates (about the axis of the associated spindle) its corresponding scoop will rotate from the forward position (near the free edge of the door) towards the rear of the latch mechanism (towards the hinged edge of the door). This causes the scoop to contact the latch retractor 42 and draw it back, compressing springs 44 and disengaging the latch bolt 46 from the catch plate 43.

FIG. 2 shows the inner spindle 12 and the inner cam end 24 in greater detail. The inner cam end includes scoop 82. Because the inner spindle 12 is non-rotatably connected to the inner lever handle 10 and the scoop 82 is part of the inner spindle 12, the inner lever handle 10 will always operate the latch retractor 42 and open the door when the inner handle 10 is turned.

As may also be seen in FIG. 2, the inner spindle 12 is also provided with a stop piece 88 held in with pin 90 which cooperates with the button lock mechanism 22 described more fully below.

Figure 3:
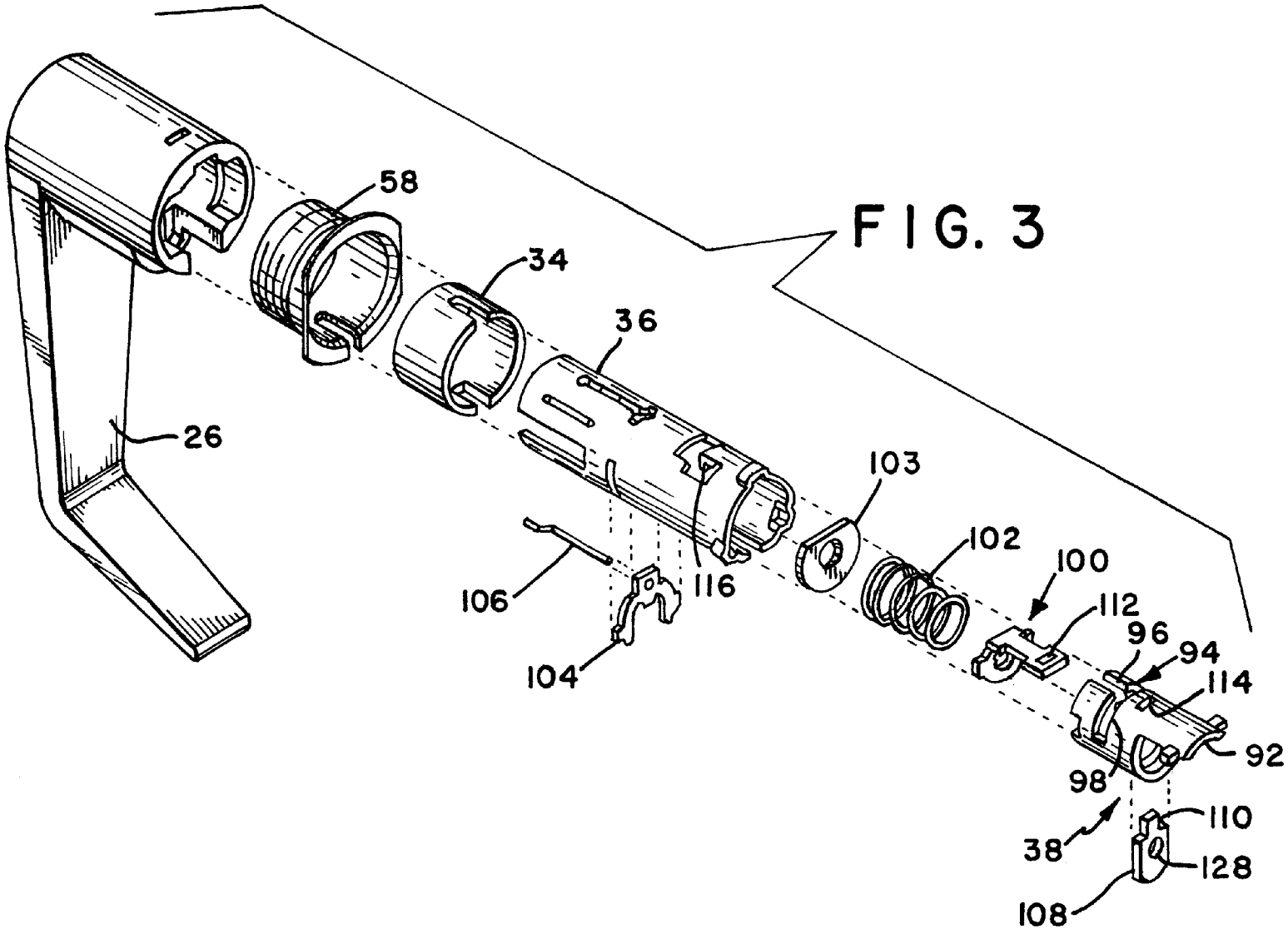
FIG. 3 is an exploded perspective view of the outer portions of the free-wheeling lock mechanism of the present invention showing the outer spindle, the outer lever h and outer cam with associated components.

FIG. 3 provides an exploded view of the principal portions of the outer side of the door lock mechanism. As in the inner side, and as is the case with most conventional (non-free-wheeling) lock mechanisms, the handle 26 is directly and non-rotatably connected to the outer spindle 36. This direct connection is different from prior art free-wheeling lock mechanism designs where the outer spindle can be disengaged from the outer handle to achieve the free-wheeling operation.

The outside end of the outer spindle 36 extends through bearing 34 and outer bearing body 58 into the outer lever handle 26. The opposite end receives the outer cam 38 which includes outer scoop 92 and a T-shaped cam slot 94 having a longitudinal portion 96 and a circumferential portion 98. The outer cam 38 is hollow and has a key guide 100 in it which holds a spring 102 in the outer cam 36 between an outer stop piece 104 and the key guide 100.

A spring plate 103 is located between the spring and the outer stop piece 104, however, this piece is optional. The outer stop piece 104 is held in the outer spindle with pin 106. The key guide 100 is held in the outer cam with a lock piece 108 having a tab 110 that engages corresponding openings 112, 114 in the key guide and outer cam, respectively. The lock piece 108 engages opening 112 in the key guide 100 and extends through the key guide and through the cam perpendicular to the rotational axis of the cam 38.

The spindle 36 has an inwardly projecting finger 116 (see also FIGS. 4*a* and 4*b*) which engages the cam slot 94. The outer cam is free to slide axially relative to the outer spindle so that the inwardly projecting finger 116 may extend into either the longitudinal portion 96 or the circumferential portion 98 of the cam slot 94. The cam spring 102 biases outer cam 38 so that the finger 116 normally projects into the longitudinal portion 96 of the cam slot unless the outer cam 38 is pushed against the cam spring 102 to move the finger 116 into the circumferential portion of the cam slot.

As is the case with the inner half of the lock mechanism, the latch retractor 42 is retracted by the scoop when the cam is rotated. Thus, for the outer lever handle 26 to open the door, it must be connected to rotate the outer cam 38, and this occurs only when the inwardly projecting finger 116 is in the longitudinal portion 96 of the cam slot 94. When the inwardly projecting finger 116 is in the circumferential portion 98 of the cam slot, rotation of the outer handle over its normal range of motion cannot turn the outer cam 38 because finger 116 rides in the circumferential portion of the slot and does not turn the outer cam.

The normal angular range of motion of the handles 10, 26 is limited by the elements in their corresponding roses so that any attempt to force the handle farther does not apply force to the internal components of the lock mechanism.

From the description above it will be seen that the lock mechanism is locked by moving the outer cam 38 towards the stop 104 and holding it with the inwardly projecting finger 116 extending into the circumferential portion of the cam slot. This task is performed by the button lock mechanism 22 seen in FIG. 1. The button lock mechanism 22 includes a button 120, an actuator 122, a toggle 124 and catch 130. The button 120 projects through opening 126 in the inner lever handle 10 so that it may be easily operated from the inside of the door. Whenever the button 120 is pressed inward it locks the door. As the button moves in, it drives actuator 122 which connects to opening 128 in lock piece 108 (see FIG. 3). This pushes the outer cam 38 to compress spring 102 and moves it into the locked position where the finger 116 enters the circumferential portion 98 of the cam slot 94.

The actuator can be held in this extended and locked position in two different ways. The first is with toggle 124. The second is with catch 130. Toggle 124 engages the retractor whenever button 120 is depressed. As the button 120 is depressed, the actuator moves axially and toggle 124 passes by an edge of the retractor. As it passes this edge, it pivots on pivot 132, then springs back into a latched position to engage the edge of the retractor 42. This holds the actuator and button in the depressed and locked position until the retractor is operated to open the door. Whenever the retractor is pulled back to open the door, the edge of the retractor engaging the toggle moves sufficiently to release the toggle and the actuator will spring back, allowing spring 102 to push the outer cam back to the unlocked position.

The second method of holding the actuator in the extended and locked position is by first pressing button 120 (as described above) then rotating the button. This rotation turns catch 130 to hold the button continuously in the locked position regardless of the motion of the retractor.

Once the actuator is in the locked position, the outer handle 26 free-wheels and cannot turn the outer cam as needed to open the door. To open the door from the locked side, key 134 must be inserted into the lock cylinder assembly 28 (see FIG. 1) and rotated. This rotation turns the lock cylinder 136 which turns the projecting tail 138. The projecting tail 138 extends into opening 140 in the key guide 100 which is shaped to engage the tail 138 and allow the tail to turn the outer cam 38. Turning outer cam 38 in this way causes the outer scoop 92 to retract the retractor 42 and open the door.

Figure 4A:
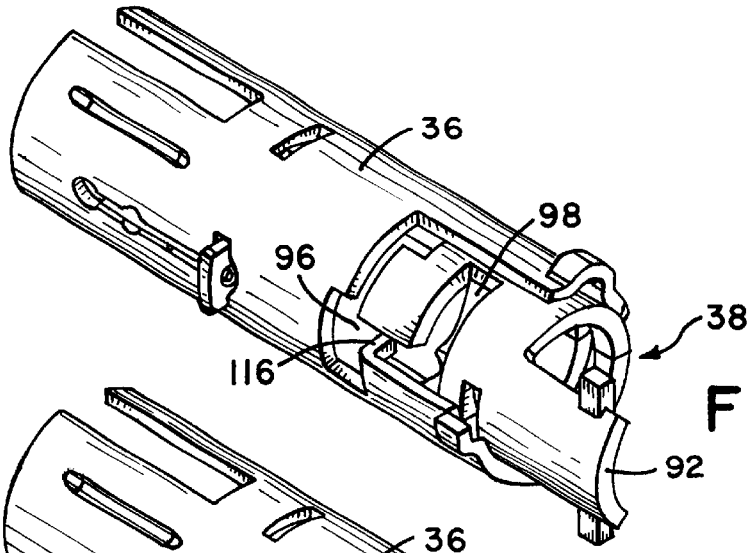
FIG. 4*a* is a perspective view of the outer spindle and the outer cam of FIG. 3 assembled with the outer cam in the unlocked position relative to the outer spindle, a portion of the outer spindle being cut away to show the outer cam more clearly.
Figure 4B:
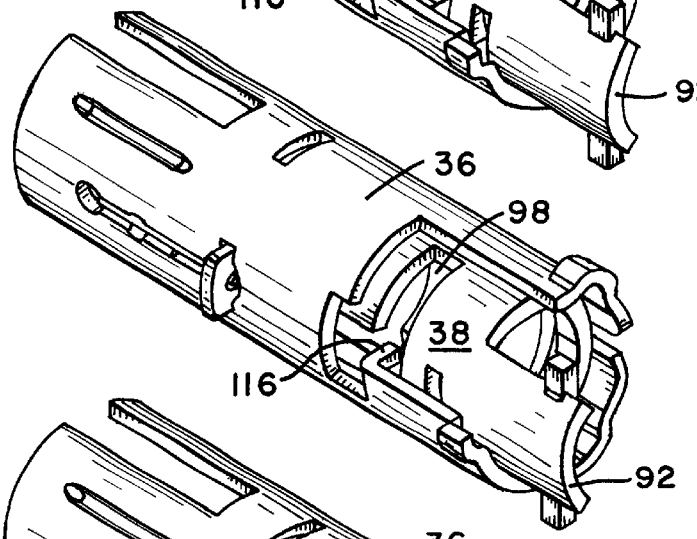
FIG. 4*b* is a perspective view of the outer spindle and the outer cam of FIG. 3 assembled with the outer cam in the locked and free-wheeling position relative to the outer spindle, a portion of the outer spindle being cut away to show the outer cam.
Figure 4C:
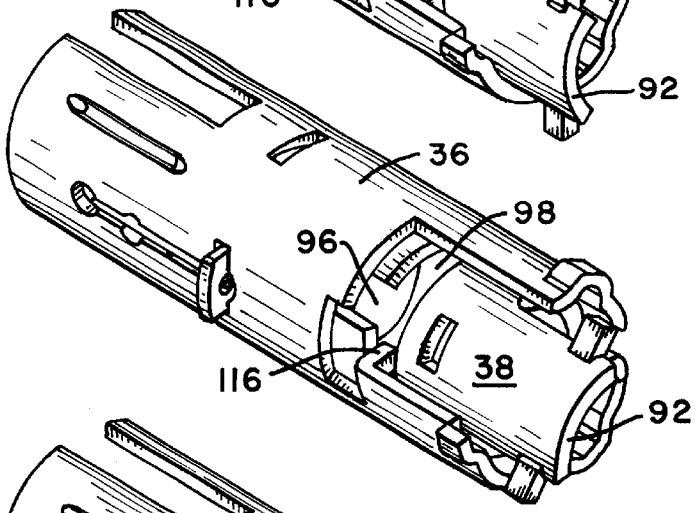
FIG. 4*c* is a perspective view of the outer spindle and the outer cam of FIG. 4*b*, showing the outer spindle partially turned relative to the outer cam, and the outer cam in the locked and free-wheeling position. A portion of the outer spindle has been cut away to more clearly show the outer cam.
Figure 4D:
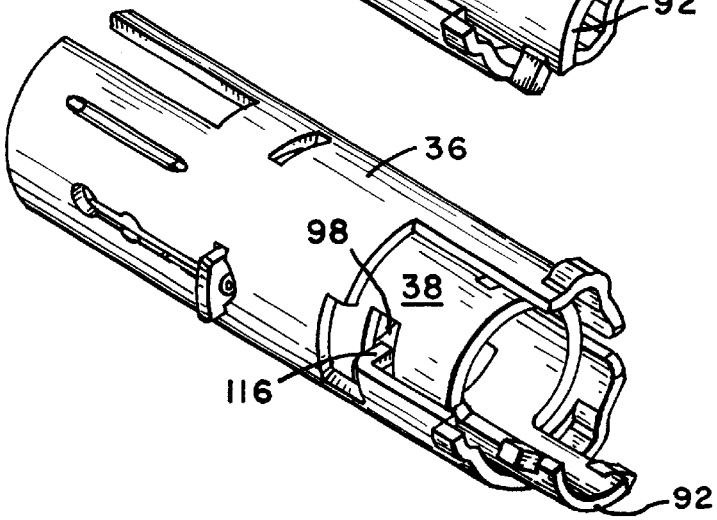
FIG. 4*d* is a perspective view of the outer spindle and the outer cam of FIG. 4*c*, except that the outer spindle is shown turned in the opposite direction from the position shown in FIG. 4*c*.

FIGS. 4*a* to 4*d* show the relationship between the outer cam and the outer spindle. A portion of the outer spindle has been removed from each drawing to clearly show how the finger 116 interacts with the cam slot 94 to lock and unlock the door. FIG. 4*a* shows the outer cam 38 in the unlocked position. The finger 116 is in the longitudinal portion 96 of the cam slot. FIGS. 4*b*–4*d* show the outer cam 38 in the locked position. In these drawings the finger 116 is in the circumferential portion 98 of the cam slot with the outer spindle being rotated relative to the outer cam 38 as occurs during free-wheeling operation.

FIG. 4*b* shows no relative rotation between the outer spindle and the outer cam 38. This is the relationship between these components when the door handle 26 is locked, but not turned. FIGS. 4*c* and 4*d* show the relationship between these components when an attempt is made to turn the door either clockwise (FIG. 4*c*) or counterclockwise (FIG. 4*d*) when the door is locked and free-wheeling.

Figure 5:
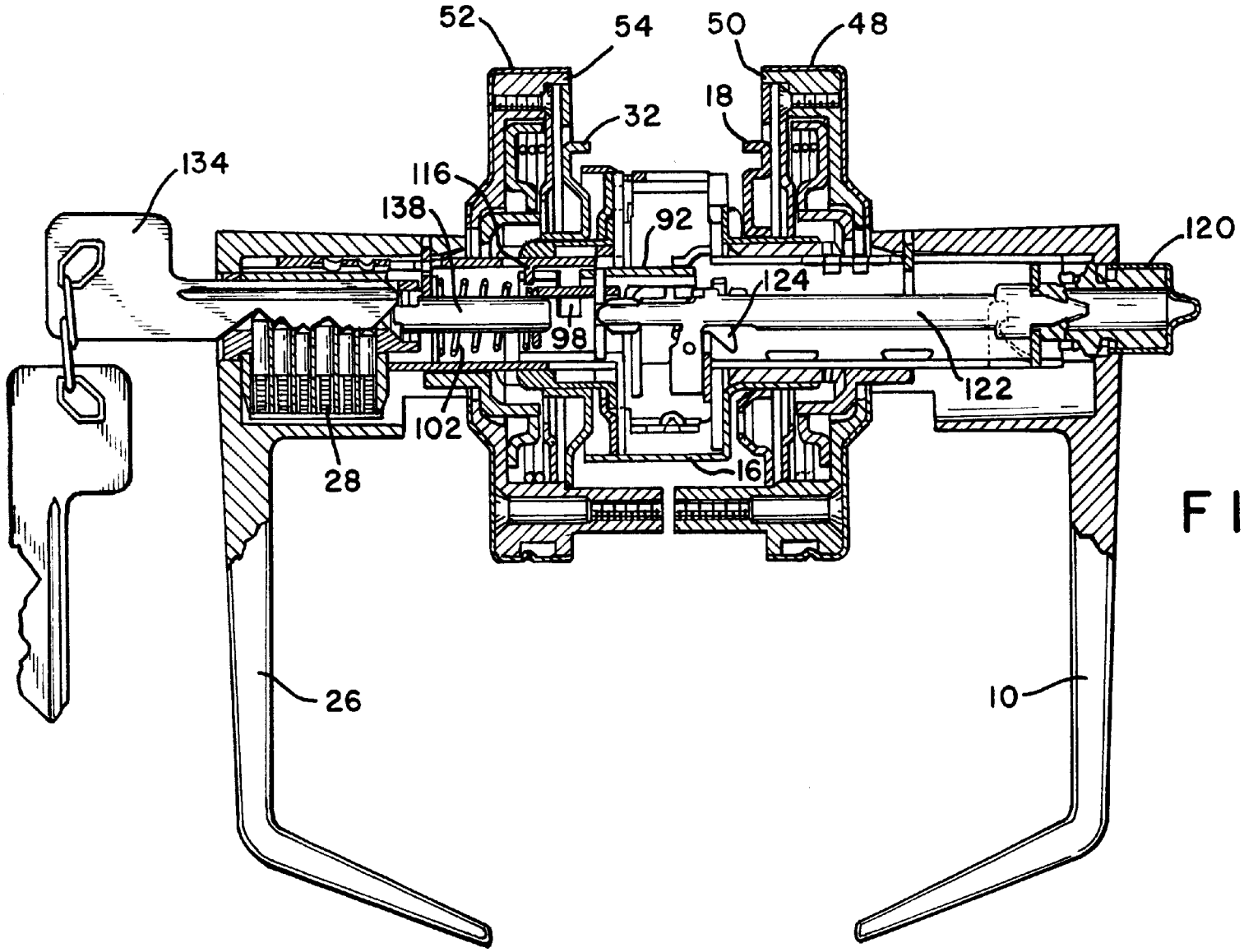
FIG. 5 is a cross-sectional view of the assembled free-wheeling lock mechanism of the present invention taken through a horizontal plane passing through the centerline of the lock mechanism and through the lever handles showing the lock mechanism in the unlocked position.

A cross-sectional view of the assembled lock mechanism of the present invention is shown in FIG. 5. The lock is shown in the unlocked position. It can be seen that finger 116 is in the longitudinal portion 96 of the cam slot, the cam spring 102 is not compressed, the button 120 is not pressed in (relative to handle 10) and the toggle 124 is not engaging the edge of the retractor. Springs 44 are not show in this view, or in FIG. 6, to make it easier to see the toggle mechanism.

Figure 6:
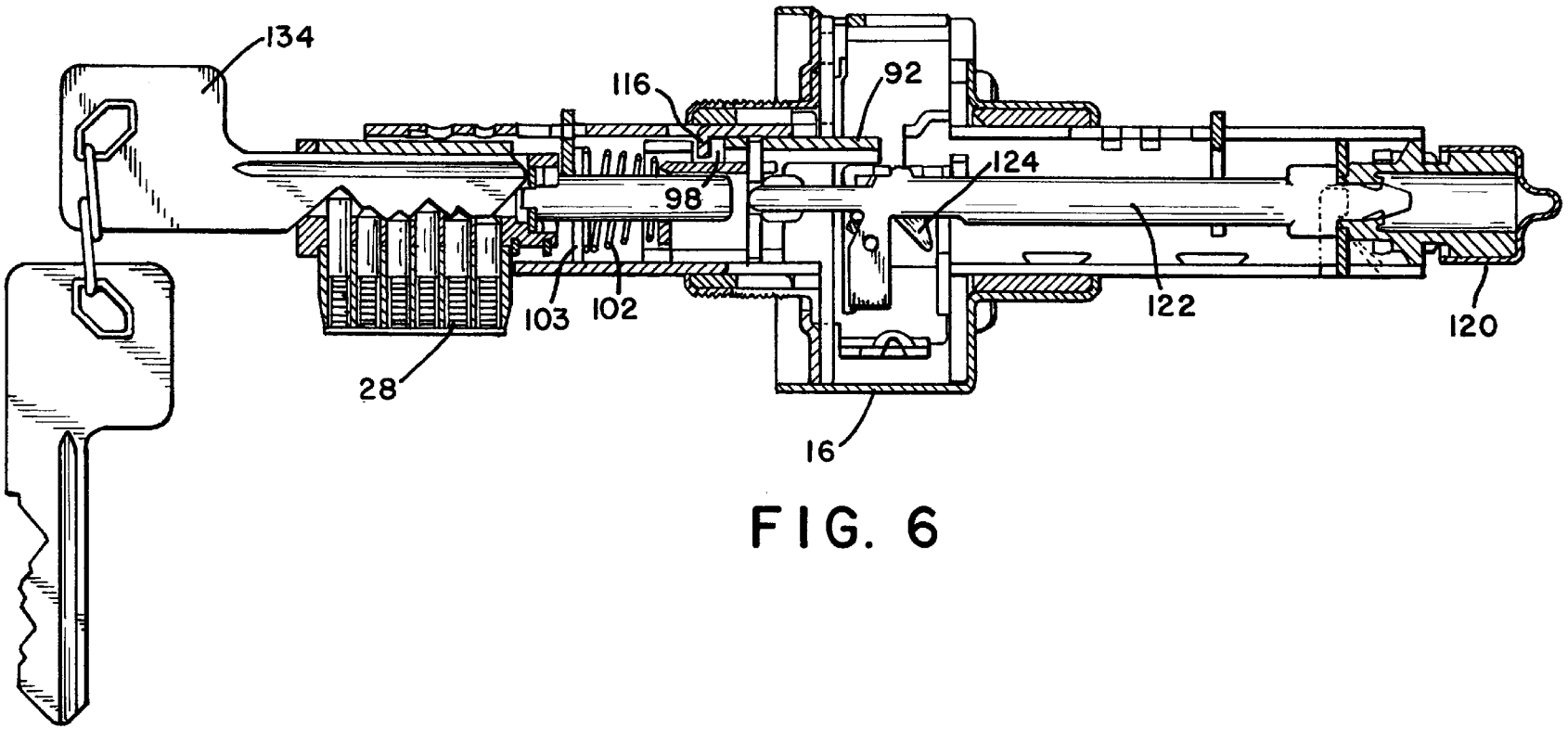
FIG. 6 is a cross-sectional view of a portion of the free-wheeling lock mechanism of the present invention showing the inner and outer spindles assembled with the lock mechanism in the locked and free-wheeling position.

FIG. 6 shows just the cylindrical lock body assembly elements of the lock with the outer cam 38 in the locked position. In this view toggle 124 engages the edge of the retractor. Cam spring 102 is compressed, and the outer cam 38 is closer to the lock cylinder 28 with the finger 116 in the circumferential portion 98 of the cam slot, allowing the mechanism to free-wheel.

In the preferred embodiment of the invention, the inner and outer stop pieces 88, 104, as well as the lock piece 108 and the key guide 100 are all constructed of plastic, most preferably an engineering plastic. Plastic construction allows the relatively inexpensive shaping of the plastic component by molding or other similar low-cost operation to form the various tabs and openings in these components which attach them to their surrounding pieces or which engage other components.

By way of example, the outer cam 38 seen in FIG. 3 receives the key guide 100 which has various tabs on its outer perimeter engaging corresponding notches in the outer edge of cam 38. The lock piece 108 then engages opening 112 in the key guide and extends through the cam with its tab 110 extending into opening 114 of the outer cam 38. In this way these relatively inexpensive components are assembled by snapping them together to produce a precision component needed for the lock mechanism. The finished cam has the portions that need higher strength and wear performance, such as the cam scoop 92, formed of metal with the components that need lower strength formed of plastic.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A lock mechanism comprising:

a latch retractor;

a spindle adapted for non-rotatable connection to a handle, the spindle having an inwardly projecting finger; and a cam rotatably held within the spindle, the cam having a cam scoop and a cam slot, the cam slot having a longitudinal portion and a circumferential portion and the cam scoop retracting the latch retractor when the cam is rotated, the cam being axially slidable relative to the spindle from an unlocked position to a locked position, in the unlocked position the finger projecting inwardly from the spindle into the longitudinal portion of the cam slot to couple the spindle to the cam and in the locked position the finger projecting inwardly from the spindle into the circumferential portion of the cam slot allowing the spindle to free-wheel relative to the cam.

2. The lock mechanism of claim 1 further including a cam spring biasing the cam to axially slide the cam relative to the spindle and position the finger in the longitudinal portion of the cam slot.

3. The lock mechanism of claim 2 further including a lock cylinder assembly having a projecting tail and wherein the cam includes an opening for receiving the lock cylinder tail, the lock cylinder rotating the cam with the lock cylinder tail to retract the retractor.

4. The lock mechanism of claim 3 further including a key guide, the key guide being non-rotatably held in the cam and wherein the key guide includes an opening for receiving the lock cylinder tail.

5. The lock mechanism of claim 4 wherein the key guide is non-rotatably held in an end of the cam opposite the cam scoop.

6. The lock mechanism of claim 5 wherein the key guide is formed of plastic.

7. The lock mechanism of claim 6 wherein the key guide is non-rotatably held in the cam by a lock piece, the lock piece engaging the key guide and extending through the key guide and through the cam perpendicular to an axis of the cam.

8. The lock mechanism of claim 7 wherein the lock piece is formed of plastic.

9. The lock mechanism of claim 7 further including a cam spring operating between the spindle and the key guide to urge the cam towards the unlocked position.

10. The lock mechanism of claim 9 wherein the cam spring operates between a stop piece located in the spindle and the key guide to urge the cam towards the unlocked position.

11. The lock mechanism of claim 10 wherein the stop piece is formed of plastic.

12. The lock mechanism of claim 9 further including:

a second spindle adapted for non-rotatable connection to a second handle, the second spindle being located on an opposite side of the latch retractor from the first spindle; and a button lock mechanism mounted in the second spindle, the button lock mechanism contacting the cam and being axially movable to move the cam between the locked and unlocked positions.

13. The free-wheeling lock mechanism of claim 12 wherein the latch retractor contacts the button lock mechanism, and the button lock mechanism is rotatable between first and second positions, the first position allowing the cam to return to the unlocked position whenever the latch retractor is retracted and the second position holding the cam in the locked position before and after the latch retractor is retracted.

14. The lock mechanism of claim 1 further including a second spindle adapted for non-rotatable connection to a second handle, the second spindle being located on an opposite side of the latch retractor from the first spindle, the second spindle having a second cam scoop at an end thereof.

15. The lock mechanism of claim 1 further including: a lever handle having a hollow shaft receiving and engaging the spindle; and a rose having a spring supporting the lever handle in a horizontal orientation.

16. The lock mechanism of claim 1 further including:

a second spindle adapted for non-rotatable connection to a second handle, the second spindle being located on an opposite side of the latch retractor from the first spindle; and a button lock mechanism mounted in the second spindle, the button lock mechanism contacting the cam and being axially movable between depressed and released positions to move the cam between the locked and unlocked positions.

17. The lock mechanism of claim 16 wherein the button lock mechanism includes an actuator projecting through the latch retractor to contact the cam, the actuator moving the cam between the locked and unlocked positions.

18. The lock mechanism of claim 17 wherein the actuator includes a catch, the catch engaging the retractor and causing the actuator to hold the cam in the locked position when the button lock mechanism is depressed and the catch releasing the actuator from the retractor to return the cam to the unlocked position when the retractor is retracted.

19. A lock mechanism comprising:

an inner lever handle;

an outer lever handle;

a generally cylindrical lock body housing having an inner bearing and an outer bearing;

a latch retractor adapted to retract a latch bolt, the latch retractor being mounted in the lock body housing;

an inner spindle journaled in the inner bearing and non-rotatably connected to the inner lever handle;

an outer spindle journaled in the outer bearing and non-rotatably connected to the outer lever handle, the outer spindle being located on an opposite side of the latch retractor from the inner spindle and having an inwardly projecting finger;

an outer cam rotatably held within the outer spindle, the outer cam having an outer cam scoop extending into the latch retractor and a cam slot, the cam slot having a longitudinal portion and a circumferential portion and the outer cam scoop retracting the latch retractor when the outer cam is rotated, the outer cam being axially slidable relative to the outer spindle from an unlocked position to a locked position, in the unlocked position the finger projecting inwardly from the outer spindle into the longitudinal portion of the cam slot to couple the outer spindle to the outer cam and in the locked position the finger projecting inwardly from the outer spindle into the circumferential portion of the cam slot allowing the outer spindle to free-wheel relative to the outer cam;

an outer cam spring biasing the outer cam to axially slide the outer cam relative to the spindle and position the finger in the longitudinal portion of the cam slot; and an inner cam scoop non-rotatably connected to the inner spindle, the inner cam scoop extending into the latch retractor and retracting the latch retractor when the inner spindle is rotated.

20. The lock mechanism of claim 19 further including a button lock mechanism mounted in the inner spindle, the button lock mechanism contacting the outer cam and being axially movable between depressed and released positions to move the cam between the locked and unlocked positions.

* * * * *

UNITED STATES PATENT AND TRADEMARK OFFICE

CERTIFICATE OF CORRECTION

PATENT NO. : 6,357,270 B1
DATED : March 19, 2002
INVENTOR(S) : Cesar Vazquez

It is certified that error appears in the above-identified patent and that said Letters Patent is hereby corrected as shown below:

Column 3,
Line 29, delete "h" and substitute therefor -- handle --.

Signed and Sealed this

Twenty-fifth Day of June, 2002

*Attest:*

*Attesting Officer*

JAMES E. ROGAN
*Director of the United States Patent and Trademark Office*